US007897948B2

(12) United States Patent
Jonkers et al.

(10) Patent No.: US 7,897,948 B2
(45) Date of Patent: Mar. 1, 2011

(54) EUV PLASMA DISCHARGE LAMP WITH CONVEYOR BELT ELECTRODES

(75) Inventors: Jeroen Jonkers, Aachen (DE); Jakob Willi Neff, Kelmis (BE); Ralf Pruemmer, Geilenkirchen-Immendorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 195 days.

(21) Appl. No.: 12/439,696

(22) PCT Filed: Aug. 29, 2007

(86) PCT No.: PCT/IB2007/053480

§ 371 (c)(1),
(2), (4) Date: Mar. 3, 2009

(87) PCT Pub. No.: WO2008/029327

PCT Pub. Date: Mar. 13, 2008

(65) Prior Publication Data

US 2009/0250638 A1 Oct. 8, 2009

(30) Foreign Application Priority Data

Sep. 6, 2006 (EP) ..... 06120170
Sep. 11, 2006 (EP) ..... 06120419

(51) Int. Cl.
*H05G 2/00* (2006.01)

(52) U.S. Cl. ..... 250/504 R; 250/492.1; 250/493.1

(58) Field of Classification Search ..... 250/423 R, 250/428, 492.1, 493.1, 504 R; 313/150, 313/163, 165, 170, 171, 172
See application file for complete search history.

(56) References Cited

U.S. PATENT DOCUMENTS 4,896,341 A 1/1990 Forsyth et al.
2002/0094063 A1 7/2002 Nishimura et al.

(Continued)

FOREIGN PATENT DOCUMENTS

DE 102006027856 B3 11/2007

(Continued)

OTHER PUBLICATIONS

Database WPI Week, Jul. 1976, Derwent Publications Ltd., London, XP002468647.

*Primary Examiner*—David A Vanore
*Assistant Examiner*—Michael Maskell

(57) ABSTRACT

The present invention relates to a plasma discharge lamp for generating EUV radiation and/or soft X-rays by means of an electrically operated discharge. The proposed lamp comprises at least two electrodes arranged in a discharge space at a distance from one another to form a gap which allows the ignition of a plasma (14) in a gaseous medium between said electrodes. A metal applying device applies a metal to a surface of said electrodes. The electrodes are formed of conveyer belts (15) driven to transport the metal to said gap, wherein for each of the electrodes a shaper element (13) is provided at the gap to ensure a proper form and distance of the electrodes at the gap. An energy beam device (4) is adapted to direct an energy beam onto at least one of said surfaces in the gap evaporating said applied metal at least partially thereby producing said gaseous medium. With the proposed plasma discharge lamp high input powers can be achieved at a compact design of the lamp.

15 Claims, 3 Drawing Sheets

U.S. PATENT DOCUMENTS

2008/0006783 A1* 1/2008 Hergenhan et al. ..... 250/504 R
2008/0277599 A1* 11/2008 Soer et al. ..... 250/492.22

FOREIGN PATENT DOCUMENTS

JP 11064598 A 5/1999
JP 2008004632 A 1/2008
WO 2005025280 A2 3/2005

* cited by examiner

EUV PLASMA DISCHARGE LAMP WITH CONVEYOR BELT ELECTRODES

FIELD OF THE INVENTION

The present invention relates to a plasma discharge lamp for generating EUV radiation and/or soft X-rays by means of an electrically operated discharge, comprising at least two electrodes arranged in a discharge space at a distance from one another to form a gap which allows the ignition of a plasma in a gaseous medium between said electrodes, a device for applying a metal to a surface of said electrodes in said discharge space and an energy beam device adapted to direct an energy beam onto at least one of said surfaces in the gap evaporating said applied metal at least partially thereby producing said gaseous medium.

Plasma discharge lamps for generating EUV radiation (EUV: extreme ultraviolet) or soft X-rays, i.e. radiation in the wavelength region of around 1 nm to 20 nm, are required in the field of EUV lithography, microscopy or metrology. For most applications high conversion efficiency together with a long life time of the lamps is desirable.

BACKGROUND OF THE INVENTION

The above requirements are fulfilled by the EUV plasma discharge lamp disclosed in WO 2005/025280 A2. The EUV lamp of this document comprises two electrode wheels arranged in a discharge space at a distance from one another to form a gap which allows the ignition of a plasma in a gaseous medium between the electrodes, as can be seen in FIG. 1. The electrode wheels 1 are rotatably mounted and partially dip into temperature controlled baths 2 comprising a liquid metal, for example tin. The material of the electrode wheels 1 allows the wetting of the electrodes by liquid tin, i.e. the surface of the electrode wheels 1 is covered with a thin layer of tin when rotating around rotation axis 3 through the tin baths 2. With a pulsed laser 4, tin is evaporated from one of the electrode wheels in the gap. The vapor cloud expands towards the second electrode wheel and after a certain time a short circuit is created between the electrode wheels. The capacitor bank 5, which is connected through an isolated feed through 6 to the tin baths 2, and therefore also to the electrode wheels 1, discharges and a hot plasma is created which emits the desired EUV radiation. The whole arrangement is situated in a vacuum vessel 8, which reaches at least a basic vacuum of $10^{-4}$ hPa. With this vacuum higher voltages from the capacitor bank 5 can be applied to the electrodes 1, for example 2 to 10 kV, without leading to an uncontrolled disruptive discharge. The tin layer 7 on the surface of the electrode wheels 2 is controlled in thickness by wipers 9. The thickness is typically controlled to be in the range between 0.5 μm and 40 μm. In order to avoid transport of evaporated tin to other parts of the lamp, metal shields 10 are arranged inside the lamp. Optical elements like mirrors outside the lamp are protected by a debris mitigation unit 11 which is arranged at the emissive side of the lamp. Such a debris mitigation unit 11 allows the pass of the radiation and suppresses the pass through of the metal vapor. The figure also schematically shows two heater/cooling units 12 for maintaining the metal melt in the baths 2 at a preset temperature.

Such a EUV plasma discharge lamp has the following advantages. Since tin can be used as plasma fuel, a high conversion efficiency of the energy stored on the capacitor bank to EUV is obtained. Since the electrodes rotate, the heat generated by the plasma is spreading over a large surface, which allows high average input powers. The tin layer on the wheels is continuously regenerated, so that electrode erosion does not change the shape of the electrodes. Hence, a very long life time of the lamp is obtained. The liquid tin used for the electrical contact between the capacitor bank and the rotating electrode wheels avoids the requirement of sliding contacts or of a rotating capacitor bank.

The critical region around the plasma is cooled by rotating the electrodes, which means that the input power scales proportionally with the rotation frequency. However, the rotation frequency is limited for the following reason. The centrifugal forces accelerate the tin outwards and at high rotation frequencies droplets are created, i.e. the tin layer tears off. This process can be shifted toward higher rotation frequencies by reducing the thickness of tin film, for instance by appropriate wipers 9. Another possibility is to increase the diameter of the electrodes, which reduces the centrifugal forces ($\omega^2 R$) at the same velocity ($\omega R$). The drawback of this solution is that extremely large wheels are necessary which improves neither the mechanical stability nor the compactness of the lamp.

SUMMARY OF THE INVENTION

It is an object of the present invention to provide a plasma discharge lamp for generating EUV radiation and/or soft X-rays by means of an electrically operated discharge, which can use metal vapor for plasma generation and allows a more compact design for high input powers.

The object is achieved with the plasma discharge lamp according to claim 1. Advantageous embodiments of the lamp are subject of the sub claims and are furthermore disclosed in the following description and examples for carrying out the invention.

The proposed plasma discharge lamp for generating EUV radiation and/or soft X-rays by means of an electrically operated discharge comprises at least two electrodes arranged in a discharge space at a distance from one another to form a gap which allows the ignition of a plasma in a gaseous medium between said electrodes. A metal applying device is arranged to apply a metal to a surface of said electrodes. Preferably, said metal applying device comprises two containers with a metal melt and each of said electrodes dips into one of said containers to apply the metal melt to the surface of said electrodes. The metal applying device can also be formed, for example, of one or several evaporating or sputtering devices or of one or several rollers for applying the metal or metal melt. In the present plasma discharge lamp the electrodes are formed of conveyer belts driven to transport the metal to said gap. For each of the electrodes a shaper element is provided at the gap to ensure a proper form and distance of the electrodes at the gap. The conveyer belt is moved over the shaper element to transport the metal on its surface to the gap. An energy beam device, in particular a laser, is adapted to direct an energy beam onto at least one of said surfaces in the gap evaporating the applied metal at least partially thereby producing said gaseous medium.

With such conveyer belts as electrodes, i.e. as cathode and anode, of the plasma discharge lamp it is possible to achieve a compact lamp design and at the same time a sufficient cooling of the electrodes for a higher input power.

The proposed plasma discharge lamp is preferably designed like the plasma discharge lamp of WO 2005/025280 A2, which is incorporated herein by reference, except of the design and movement of the two electrodes. The use of conveyer belts instead of electrode wheels has the further advantage that it allows more flexibility in the mechanical design. For instance, the contact surface between the belt and the melted metal can be easily increased by making several passes or turns under the surface of the melted metal in the corresponding metal bath. This improves the cooling of the belt significantly.

In one embodiment of the proposed plasma discharge lamp the shaper elements are formed to provide a curved surface at the gap, wherein the curved surface has a sufficiently large smallest radius of curvature to allow a high driving speed of the belt without the risk that liquid metal tears off at the shaper elements due to centrifugal forces. Since the remaining portion of the shaper elements is not in contact with the conveyer belts, this portion can be formed to occupy a minimum space. Such shaper elements may have the profile of a segment of a circle, for example made of a cut off portion a circular disk with a thickness of the width of the belt or smaller. Also other curved forms are possible. Compared with rotating wheels, therefore, such shaper elements can provide a large radius of curvature of the electrodes at the gap without occupying the same space. Further required deflection elements for the guidance of the belt with a far smaller curvature are then positioned in the baths of the liquid metal or are combined with an appropriate cover which prevents the tearing off of the liquid metal film due to centrifugal forces.

The electrical connection between the capacitor bank of the power supply and the electrodes can be achieved through the baths of the liquid metal in the same manner as already disclosed in WO 2005/025280 A2. Nevertheless, since the shaper elements in the above embodiment are fixed and do not rotate, the electrical connection to the electrodes can also be achieved through the shaper elements. This has the advantage that the containers with the metal melt can be separated by a sufficient distance from one another to allow the emission of plasma generated EUV radiation and/or soft X-rays in this direction, i.e. the radiation can pass between the two containers. Electrical connection of the electrodes through the containers in such a case may result in an undesirably high inductance of the system.

In another arrangement the moving plane of the conveyor belts is inclined with respect to a vertical plane, i.e. inclined with respect to the paper plane of FIGS. 2 to 5, to allow passing of the plasma generated EUV radiation and/or soft X-rays besides the containers.

In a further embodiment of the present plasma discharge lamp, the shaper elements are formed of rotating rollers with a smaller radius of curvature as that of the above embodiment. In order to avoid the tearing off of liquid metal from the surface at these shaper elements, additional pairs of cooled rollers are provided upwards the shaper elements with respect to the driving direction of the belts. These additional rollers are cooled such that the liquid metal film on the surface of the belt, which passes between the pair of cooled rollers is cooled down below the melting temperature, thereby forming a solid layer on the conveyer belt. With this solid layer, the metal melt does not move and the problem of the centrifugal forces at higher driving speeds does not occur so that the curvature of the shaper elements and other deflection elements downwards of the cooled rollers can be held small even at higher driving speeds.

The conveyer belts of the present plasma discharge lamp are made of a material which can be wetted by liquid metal, in particular tin, and has a sufficiently high heat resistance to withstand the temperatures during operation of the lamp. Preferably this material has also a high heat conductance. The belts may be made for example of Mo, W or Nb. The belts can be closed or open belts. In case of open belts, for each belt two carrier rollers are provided between which the belt is winded forward and backward.

These and other aspects of the invention will be apparent from an elucidated with reference to the embodiments described herein after.

BRIEF DESCRIPTION OF THE DRAWINGS

The proposed plasma discharge lamp is described in the following by way of examples in connection with the accompanying figures without limiting the scope of protection as defined by the claims. The figures show:

DETAILED DESCRIPTION OF EMBODIMENTS

Figure 1:
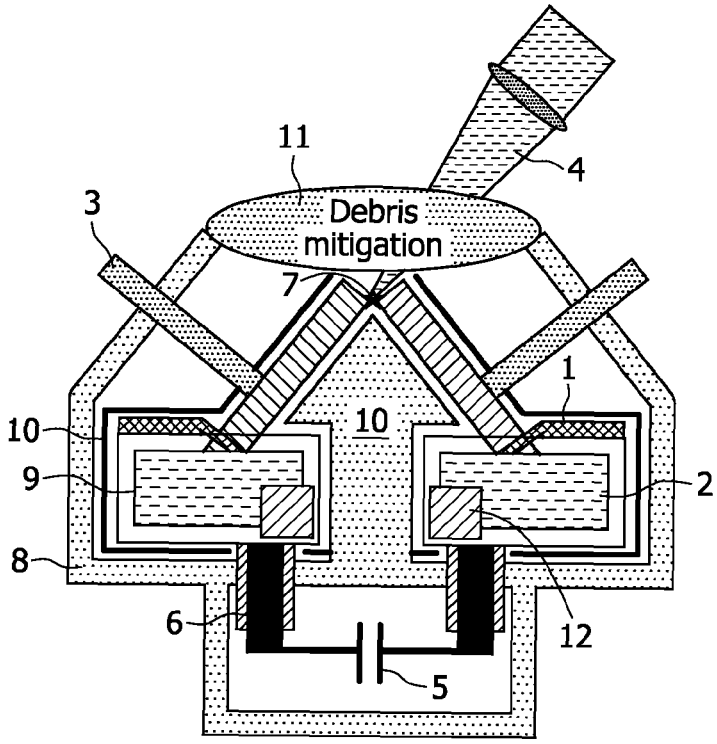
FIG. 1 an example of an EUV lamp of the prior art.

The EUV plasma discharge lamp of FIG. 1 has already been described in the introductory portion of the present description. In the following examples several embodiments of the design of the electrodes of the proposed EUV plasma discharge lamp are described, which can be used to substitute the electrode arrangement of the EUV plasma discharge lamp of FIG. 1. The further components of this lamp can be identical to this known lamp so that these components are not further explained in connection with the following examples.

Figure 2:
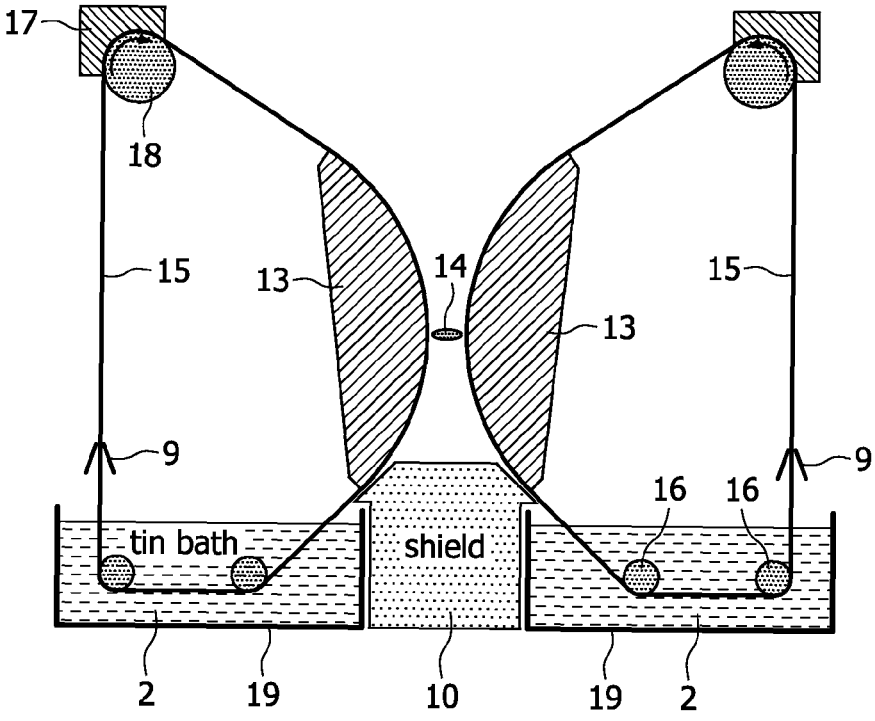
FIG. 2 an example of the design of the electrodes in the proposed EUV lamp.

In order to achieve a high rotational speed of the electrode wheels of FIG. 1, which is necessary for a better cooling and corresponding higher input power, the radius of the electrode wheels has to be increased in order to avoid the tearing off of the liquid metal film by centrifugal forces. With such large wheels, however, a compact EUV lamp can not be realized. Large wheels are avoided in the present EUV lamp, when conveyer belts as electrodes in combination with so called shaper elements are used instead of electrode wheels. FIG. 2 shows an example of such an electrode design. The shaper elements 13 define the small segment of the circle near the plasma, which is indicated with reference sign 14. Therefore, the dimensions of the shaper elements 13 can be relatively small in combination with a large radius of curvature as is evident from FIG. 2. Instead of a segment of a circle the shaper elements can also have other kinds of curvatures, for example hyperbolic. Smaller curvatures are inevitable at other components for guidance of the conveyer belt 15, but these can be positioned in the tin baths 2 below the liquid surface (as indicated as deflection wheels 16) or are combined with a cover 17, as shown in connection with the deflection wheels 18. In the last case, the conveyer belt 15 is squeezed by the cover 17 and the deflection wheel 18 so that the liquid tin can not tear off through centrifugal forces. The shaper elements 13 can be of the same material as the conveyer belt.

In the present example, the conveyer belt 15 is driven by the deflection rollers 18 which are connected to an appropriate driving motor. The conveyer belts are guided through the container 19 containing a tin bath 2, thereby wetting the surface of the conveyer belt 15 with a thin tin film. The thickness of this film is controlled by wipers 9 which are appropriately arranged upwards of the shaper elements 13. In FIG. 2 also a shield 10 for avoiding the mitigation of liquid tin between the two containers 19 is shown. The laser beam, the capacitor bank, the heating/cooling system and the vacuum vessel are not depicted in this and the following figures. As already mentioned, these and other components can be arranged and designed in the same manner as shown with the EUV plasma discharge lamp of FIG. 1.

Figure 3:
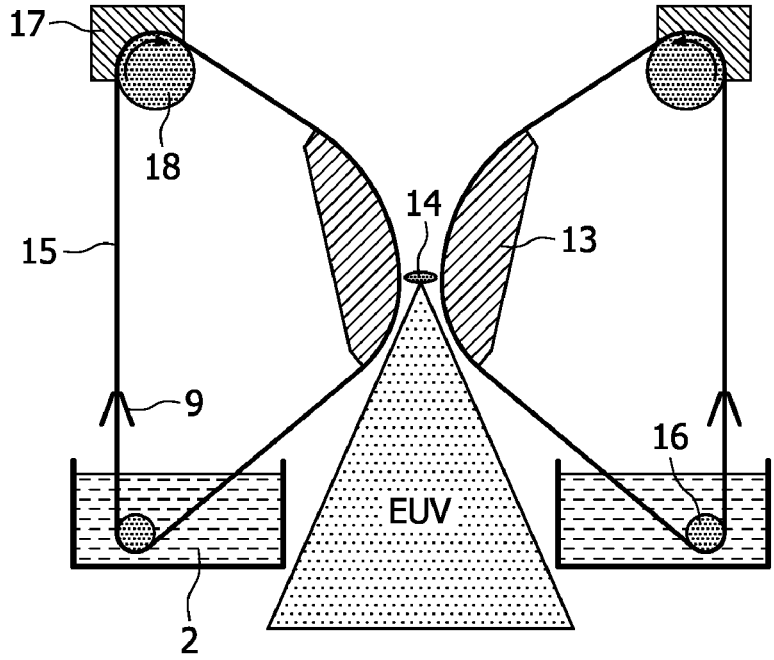
FIG. 3 a further example of the design of the electrodes in the proposed EUV lamp.

Some EUV illumination systems require that the EUV radiation produced by the plasma is directed downwards, i.e. in the direction of the tin baths 2. This is rather difficult to realize with the wheel based system of FIG. 1. It can be achieved with the proposed electrode design as shown in FIG. 3. In this case, the fixed shaper elements 13 can be used as electrical contact between the capacitor bank and the conveyer belt 15 so that the inductance of the system is not too high. Such a high inductance is caused by a large spacing between the containers 19 containing the tin baths 2, if the current has to flow via the baths to the electrodes.

Figure 4:
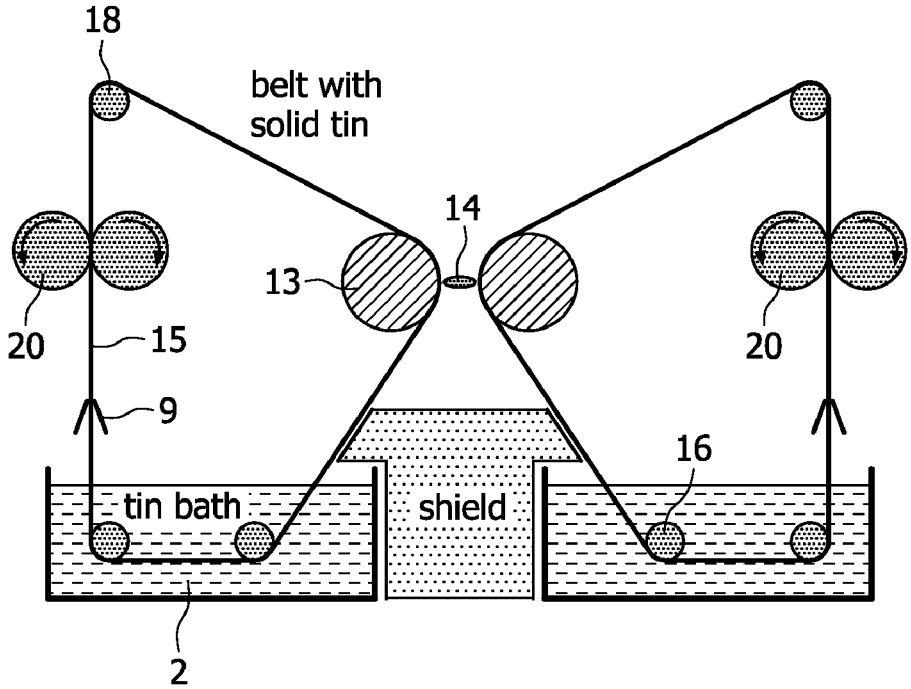
FIG. 4 a further example of the design of the electrodes in the proposed EUV lamp.

In the examples of FIGS. 2 and 3, the shaper elements 13 are fixed parts. The embodiment of FIG. 4 shows an example in which the shaper elements 13 rotate. In this figure, cooled rollers 20 are provided and used to cool the conveyer belts 15 below the melting point of tin. Having the conveyer belt 15 covered with solid tin has the advantage that much higher driving velocities for the belt can be obtained, without the risk that the tin tears off. To this end the cooled rollers 20 are arranged in the driving direction before the first deflection wheel 18 as can be seen in FIG. 4.

Figure 5:
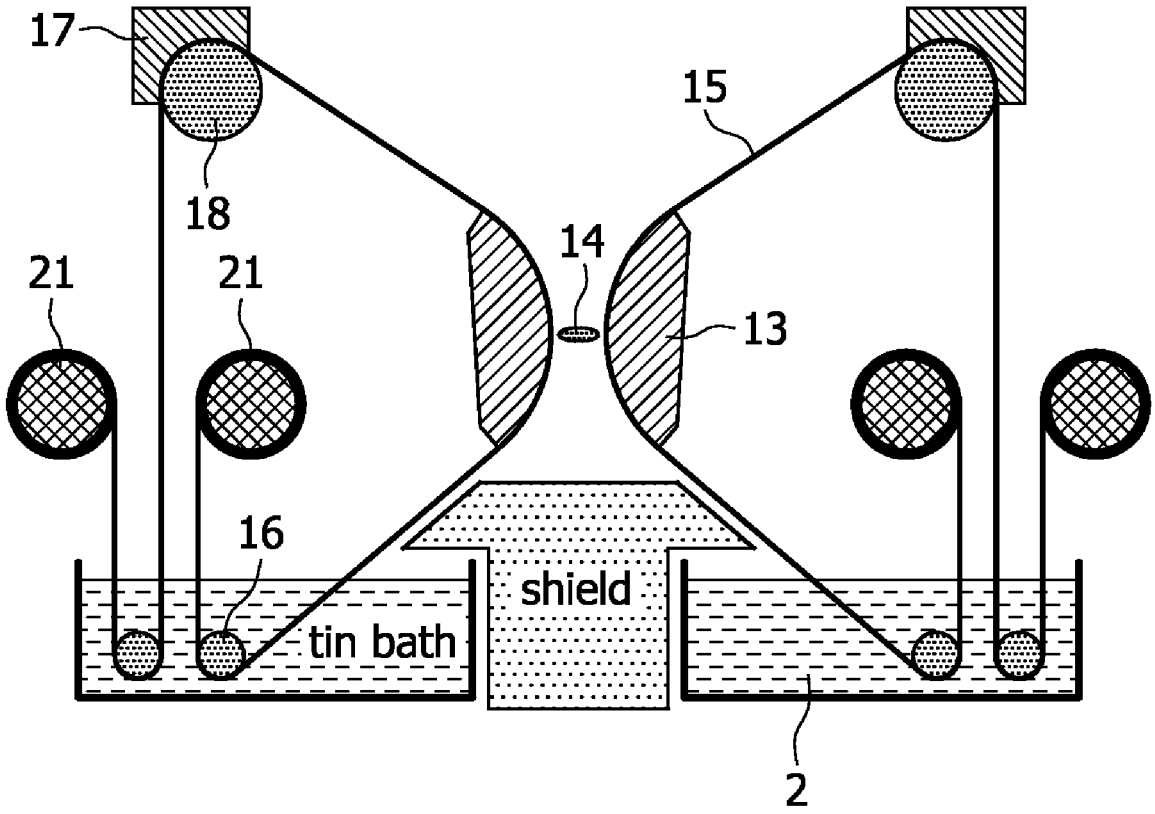
FIG. 5 a further example for the design of the electrodes in the proposed EUV lamp.

The exemplary embodiments of FIGS. 2 to 4 show the use of closed conveyer belts 15 as electrodes. It might however be difficult to produce such kinds of belts with a long life time. Therefore it may be of advantage to use a very long open belt that is winded onto two carrier rollers 21 as shown in FIG. 5. The driving direction of the conveyer belt 15 in this case can be changed in an illumination break of the lamp, for example in the case of EUV lithography, between the illumination of two dies. This requires that both carrier rollers 21 of each of the conveyer belts 15 are connected or connectable to an appropriate driving motor.

While the invention has been illustrated and described in detail in the drawings and foregoing description, such illustration and description are to be considered illustrative or exemplary and not restrictive; the invention is not limited to the disclosed embodiments. For example, although the figures suggest that the driving planes of the two electrodes are identical, it is also possible that these driving planes are not parallel to each other. Furthermore, the number of deflection wheels is not limited to the number shown in the figures and can be set appropriately. Different embodiments described above can also be combined, for example the embodiments of FIGS. 3 and 4 or FIGS. 4 and 5.

Other variations to the disclosed embodiments can be understood and effected by those skilled in the art in practicing the claimed invention, from a study of the drawings, the disclosure and the appended claims. In the claims, the word "comprising" does not exclude other elements or steps, and the undefined article "a" or "an" does not exclude a plurality. The mere fact that certain measures are recited in mutually different dependent claims does not indicate that a combination of these measures can not be used to advantage. Any reference signs in the claims should not be construed as limiting the scope of these claims.

LIST OF REFERENCE SIGNS

1 electrode wheel
2 tin bath
3 rotation axis
4 pulsed laser
5 capacitor bank
6 isolated field through
7 tin layer
8 vacuum vessel
9 wiper
10 metal shield
11 debris mitigation unit
12 heater/cooling unit
13 shaper element
14 plasma
15 conveyer belt
16 deflection wheel in tin bath
17 cover
18 deflection wheel outside tin bath
19 container
20 cooled rollers
21 carrier rollers

The invention claimed is:

1. Plasma discharge lamp for generating EUV radiation and/or soft X-rays by means of an electrically operated discharge, comprising at least two electrodes arranged in a discharge space at a distance from one another to form a gap which allows the ignition of a plasma (14) in a gaseous medium between said electrodes, a metal applying device to apply a metal to a surface of said electrodes, said electrodes being formed of conveyor belts (15) driven to transport the metal to said gap, wherein for each of the electrodes a shaper element (13), over which the conveyor belt (15) is moved, is provided at the gap to ensure a proper form and distance of the electrodes at the gap, and an energy beam device (4) adapted to direct an energy beam onto at least one of said surfaces in the gap evaporating said applied metal at least partially thereby producing said gaseous medium.

2. Plasma discharge lamp according to claim 1, wherein said metal applying device comprises two containers (19) with a metal melt and each of said electrodes dips into one of said containers (19) to apply the metal melt to the surface of said electrodes.

3. Plasma discharge lamp according to claim 2, wherein the electrodes are electrically connected via the metal melt in the containers (19) to a power supply (5).

4. Plasma discharge lamp according to claim 1, wherein the electrodes are electrically connected via the shaper elements (13) to a power supply (5).

5. Plasma discharge lamp according to claim 1, wherein the shaper elements (13) are formed to provide a curved surface at the gap.

6. Plasma discharge lamp according to claim 5, wherein the shaper elements have the profile of a segment of a circle.

7. Plasma discharge lamp according to claim 2, wherein deflecting elements (18) for the conveyor belts (15) outside the containers (19) are provided with covers (17) to avoid tearing off of the metal melt during deflection.

8. Plasma discharge lamp according to claim 2, wherein the conveyor belts (15) are guided in several turns through the metal melt in the containers (19).

9. Plasma discharge lamp according to claim 2, wherein the containers (19) are separated to allow passing of the plasma generated EUV radiation and/or soft X-rays between the containers (19).

10. Plasma discharge lamp according to claim 9, wherein the electrodes are electrically connected via the shaper elements (13) to a power supply (5).

11. Plasma discharge lamp according to claim 2, wherein a moving plane of the conveyor belts (15) is inclined with respect to a vertical plane to allow passing of the plasma generated EUV radiation and/or soft X-rays besides the containers (19).

12. Plasma discharge lamp according to claim 2, wherein pairs of cooled rollers (20) are provided to cool down the metal melt on the conveyor belts (15) passing through the pairs of rollers (20) on its way to the gap to a temperature below a melting point of the metal melt.

13. Plasma discharge lamp according to claim 12, wherein the shaper elements (13) are rotating rollers.

14. Plasma discharge lamp according to claim 1, wherein the conveyor belts (15) are closed belts.

15. Plasma discharge lamp according to claim 1, wherein the conveyor belts (15) are open belts, which are each moved between two winding carrier rollers (21) forward and backward.

* * * * *